US008374853B2

(12) United States Patent
Ragot et al.

(10) Patent No.: US 8,374,853 B2
(45) Date of Patent: Feb. 12, 2013

(54) HIERARCHICAL ENCODING/DECODING DEVICE

(75) Inventors: Stéphane Ragot, Lannion (FR); David Virette, Pleumeur-Bodou (FR)

(73) Assignee: France Telecom, Paris (FR)

( * ) Notice: Subject to any disclaimer, the term of this patent is extended or adjusted under 35 U.S.C. 154(b) by 777 days.

(21) Appl. No.: 11/988,758

(22) PCT Filed: Jul. 7, 2006

(86) PCT No.: PCT/FR2006/050690

§ 371 (c)(1),
(2), (4) Date: Jun. 23, 2009

(87) PCT Pub. No.: WO2007/007001

PCT Pub. Date: Jan. 18, 2007

(65) Prior Publication Data

US 2009/0326931 A1 Dec. 31, 2009

(30) Foreign Application Priority Data

Jul. 13, 2005 (FR) ..... 05 52199

(51) Int. Cl.
*G10L 19/00* (2006.01)
*G10L 19/12* (2006.01)
*G10L 19/14* (2006.01)

(52) U.S. Cl. ..... 704/220; 704/219; 704/223; 704/224; 704/225; 704/262; 704/222; 704/201; 704/205; 704/200.1; 704/500; 704/501

(58) Field of Classification Search ..... 704/500, 704/502, 503, 504, 216, 219, 220, 223, 224, 704/225, 262, 222, 201, 205, 200.1, 501
See application file for complete search history.

(56) References Cited

U.S. PATENT DOCUMENTS

| | | | | |
|---|---|---|---|---|
| 5,455,888 | A * | 10/1995 | Iyengar et al. | 704/203 |
| 5,581,652 | A * | 12/1996 | Abe et al. | 704/222 |
| 5,963,898 | A * | 10/1999 | Navarro et al. | 704/220 |
| 6,446,037 | B1 * | 9/2002 | Fielder et al. | 704/229 |
| 6,681,202 | B1 * | 1/2004 | Miet et al. | 704/214 |
| 6,807,524 | B1 * | 10/2004 | Bessette et al. | 704/200.1 |
| 7,050,970 | B2 * | 5/2006 | Den Brinker | 704/220 |

(Continued)

FOREIGN PATENT DOCUMENTS

EP 1489599 A 12/2004

OTHER PUBLICATIONS

Koishida et al., "A 16-kbit/s Bandwidth Scalable Audio Coder Based on the G.729 Standard," Proceedings of the 2000 IEEE International Conference on Acoustics, Speech and Signal Processing, IEEE, vol. 2, pp. 1149-1152, XP010504931 (Jun. 2000).*

(Continued)

*Primary Examiner* — Edgar Guerra-Erazo
(74) *Attorney, Agent, or Firm* — Cozen O'Connor

(57) ABSTRACT

A system for coding a hierarchical audio signal, comprising, at least, a core layer using parametric coding by analysis by synthesis in a first frequency band, a band extension layer for widening said first frequency band into a second frequency band, or wideband. The system also comprises a wideband audio coding quality enhancement layer based on transform coding using a spectral parameter obtained from said band extension layer. Application to transmitting speech and/or audio signals over packet networks.

17 Claims, 14 Drawing Sheets

U.S. PATENT DOCUMENTS

| | | | | |
|---|---|---|---|---|
| 7,069,212 | B2 * | 6/2006 | Tanaka et al. | 704/225 |
| 7,318,035 | B2 * | 1/2008 | Andersen et al. | 704/500 |
| 7,469,206 | B2 * | 12/2008 | Kjorling et al. | 704/205 |
| 7,577,570 | B2 * | 8/2009 | Kjoerling et al. | 704/500 |
| 7,643,996 | B1 * | 1/2010 | Gottesman | 704/265 |
| 7,979,271 | B2 * | 7/2011 | Bessette | 704/219 |
| 8,024,181 | B2 * | 9/2011 | Ehara et al. | 704/217 |
| 2001/0044712 | A1 * | 11/2001 | Vainio et al. | 704/201 |
| 2002/0156621 | A1 * | 10/2002 | Den Brinker | 704/220 |
| 2003/0009325 | A1 * | 1/2003 | Kirchherr et al. | 704/211 |
| 2003/0016772 | A1 * | 1/2003 | Ekstrand | 375/350 |
| 2003/0220783 | A1 * | 11/2003 | Streich et al. | 704/200.1 |
| 2005/0004793 | A1 * | 1/2005 | Ojala et al. | 704/219 |
| 2006/0023748 | A1 * | 2/2006 | Chandhok et al. | 370/469 |
| 2008/0262835 | A1 * | 10/2008 | Oshikiri | 704/205 |
| 2009/0171672 | A1 * | 7/2009 | Philippe et al. | 704/500 |
| 2009/0192804 | A1 * | 7/2009 | Schuijers et al. | 704/500 |
| 2010/0228557 | A1 * | 9/2010 | Chen et al. | 704/500 |

OTHER PUBLICATIONS

International Telecomm Un Ication Un Ion, "G.729 based Embedded Variable bit-rate coder: An 8-32 kbit/s scalable wideband coder bitstream interoperable with G.729," ITU-T Standard Pre-Published, Geneva, CH, No. G7291 5/6, pp. 1-99 (May 29, 2006).*

Wolters et al., "A closer look inot MPEG-4 High Efficeincy AAC," AES, Oct. 2003.*

Oomen, Werner; Schuijers, Erik; den Brinker, Bert; Breebaart, Jeroen. Philips Digital Systems Laboratories, Eindhoven, The Netherlands o Philips Research Laboratories, Eindhoven, The Netherlands. AES Convention:114 (Mar. 2003) Paper No. 5852.*

Ragot et al., "A 8-32 kbit/s Scalable Wideband Speech and Audio Coding Candidate for ITU-T G729EV Standardization," 2006 IEEE International Conference on Acoustics, Speech and Signal Processing, Toulouse, France May 14-19, 2006, ICASSP 2006 Proceedings, Piscataway, N J, USA, IEEE, pp. I-1-I-4 (May 14, 2006).*

Kataoka et al. "A 16-kbit/s Wideband Speech CODEC Scalable With G.729", EuroSpeech, 1997.*

H. Taddei et al., "A Scalable Three Bit-Rates 8-14.1-24 kbit/s Audio Coder", Annals of Telecommunications, Get Lavoisier, Paris, France, vol. 55, No. 9/10, Sep. 2000, pp. 483-492.

B. Kovesi et al., "A Scalable Speech and Audio Coding Scheme with Continuous Bitrate Flexibility", Acoustics, Speech, and Signal Processing, 2004, Proceedings IEEE Int'l. Conf. on Montreal, Quebec, Canada May 17-24, 2004, Piscataway, NJ, IEEE, vol. 1, May 17, 2004 pp. 273-276.

S. Ragot et al., "A 8-32 kbit/s Scalable Wideband Speech and Audio Coding Candidate for ITU-T G729EV Standardization", Acoustics, Speech and Signal Processing, 2006, ICASSP 2006 Proceedings, 2006 IEEE Int'l. Conf. on Toulouse, France, May 14-19, 2006, Piscataway, N.J. IEEE, May 14, 2006, pp. I-1.

* cited by examiner

| Type | Parameters | Symbole |
|---|---|---|
| Filter | Coefficients (coded in LSF domain) | 1/Â(z) |
| Excitation | Fractional pitch delay | T0, T0_fac |
| | Pitch and code gains | $g_c$, $g_p$ |
| | ACELP code (4 pulses±1) | Code |

G.729 codec parameters

FIG. 2

| n | L(n) | n | L(n) |
|---|---|---|---|
| 0 | -0,000080 | 21 | 0,314908 |
| 1 | 0,000124 | 22 | 0,031076 |
| 2 | 0,000851 | 23 | -0,096290 |
| 3 | -0,000224 | 24 | -0,028436 |
| 4 | -0,002653 | 25 | 0,048337 |
| 5 | -0,000251 | 26 | 0,024427 |
| 6 | 0,005608 | 27 | -0,026001 |
| 7 | 0,002027 | 28 | -0,019564 |
| 8 | -0,009634 | 29 | 0,013356 |
| 9 | -0,006002 | 30 | 0,014441 |
| 10 | 0,014441 | 31 | -0,006002 |
| 11 | 0,013356 | 32 | -0,009634 |
| 12 | -0,019564 | 33 | 0,002027 |
| 13 | -0,026001 | 34 | 0,005608 |
| 14 | 0,024427 | 35 | -0,000251 |
| 15 | 0,048337 | 36 | -0,002653 |
| 16 | -0,028436 | 37 | -0,000224 |
| 17 | -0,096290 | 38 | 0,000851 |
| 18 | 0,031076 | 39 | 0,000124 |
| 19 | 0,314908 | 40 | -0,000080 |
| 20 | 0,467961 | | |

Low-pass filter

FIG. 5

| n | H(n) | N | H(n) |
|---|---|---|---|
| 0 | -0,000087168815 | 21 | -0,308480011420 |
| 1 | -0,000152469464 | 22 | -0,067910055357 |
| 2 | 0,000698117309 | 23 | 0,078577740974 |
| 3 | 0,001247243203 | 24 | 0,057060908444 |
| 4 | -0,001205451704 | 25 | -0,023584669507 |
| 5 | -0,003874961258 | 26 | -0,042061518609 |
| 6 | 0,000111593810 | 27 | -0,000334797564 |
| 7 | 0,007604966098 | 28 | 0,026410633670 |
| 8 | 0,004316828627 | 29 | 0,009624671304 |
| 9 | -0,010593618141 | 30 | -0,013221506095 |
| 10 | -0,013221506095 | 31 | -0,010593618141 |
| 11 | 0,009624671304 | 32 | 0,004316828627 |
| 12 | 0,026410633670 | 33 | 0,007604966098 |
| 13 | -0,000334797564 | 34 | 0,000111593810 |
| 14 | -0,042061518609 | 35 | -0,003874961258 |
| 15 | -0,023584669507 | 36 | -0,001205451704 |
| 16 | 0,057060908444 | 37 | 0,001247243203 |
| 17 | 0,078577740974 | 38 | 0,000698117309 |
| 18 | -0,067910055357 | 39 | -0,000152469464 |
| 19 | -0,308480011420 | 40 | -0,000087168815 |
| 20 | 0,571843425894 | | |

High-pass filter

FIG. 6

| Band number | MDCT coefficients index | frequencies |
|---|---|---|
| 1 | 0-7 | 0-200 |
| 2 | 8-23 | 200-600 |
| 3 | 24-39 | 600-1000 |
| 4 | 40-55 | 1000-1400 |
| 5 | 56-71 | 1400-1800 |
| 6 | 72-87 | 1800-2200 |
| 7 | 88-103 | 2200-2600 |
| 8 | 104-119 | 2600-3000 |
| 9 | 120-135 | 3000-3400 |
| 10 | 136-151 | 3400-3800 |
| 11 | 152-167 | 3800-4200 |
| 12 | 168-183 | 4200-4600 |
| 13 | 184-199 | 4600-5000 |
| 14 | 200-215 | 5000-5400 |
| 15 | 216-231 | 5400-5800 |
| 16 | 232-247 | 5800-6200 |
| 17 | 248-263 | 6200-6600 |
| 18 | 264-279 | 6600-7000 |

Division into bands

FIG. 7

| | 1 (10 ms) | | 2 (10 ms) | |
|---|---|---|---|---|
| | 1 | 2 | 3 | 4 |
| LSF (10th order) | 1+7+5+5 (18) | | 1+7+5+5 (18) | |
| Adaptive dictionary delay | 8 | 5 | 8 | 5 |
| Pitch delay parity | 1 | - | 1 | - |
| ACELP dictionary | 13+4 (17) | 13+4 (17) | 13+4 (17) | 13+4 (17) |
| Gains | 7 | 7 | 7 | 7 |
| | 80 | | 80 | |
| | | | | |
| | 1 (10 ms) | | 2 (10 ms) | |
| | 1 | 2 | 3 | 4 |
| ACELP dictionary | 13+4 (17) | 13+4 (17) | 13+4 (17) | 13+4 (17) |
| Gain | 3 | 3 | 3 | 3 |
| | 40 | | 40 | |
| | | | | |
| | (20 ms) | | | |
| WB-LSF (18th order) | 24 | | | |
| gain (gWB) | 4 | 4 | 4 | 4 |
| | 40 | | | |
| | | | | |
| | (20 ms) | | | |
| High band spectral envelope | Variable | | | |
| Low band spectral envelope | Variable | | | |
| Normalized MDCT coefficients | Variable | | | |
| | 380 | | | |

FIG. 8

HIERARCHICAL ENCODING/DECODING DEVICE

RELATED APPLICATIONS

This is a U.S. national stage of application No. PCT/FR2006/050690, filed on 7 Jul. 2006.

This application claims the priority of French patent application nos. 05/52199 filed Jul. 13, 2005, the content of which is hereby incorporated by reference.

FIELD OF THE INVENTION

The present invention relates to a hierarchical audio coding system. It also relates to a hierarchical audio coder and a hierarchical audio decoder.

The invention finds a particularly advantageous application in the field of transmission of speech and/or audio signals over packet networks, of the voice over IP type. More specifically, in this context, the invention provides a quality that can be modulated, running from a telephone band to a wideband, as a function of the bitrate capacity of the transmission and guaranteeing interworking with an existing telephone band core.

BACKGROUND OF THE INVENTION

Many techniques exist at present for converting an audio-frequency (speech and/or audio) signal into the form of a digital signal and processing the signals digitized in this way. The standard high-quality audio coding methods are generally classified as "waveform coding", "parametric coding by analysis by synthesis", and "perceptual coding in sub-bands or by transforms".

The first category includes quantizing techniques with or without memory such as PCM or ADPCM coding.

The second category includes techniques that represent the signal by means of a model, generally a linear predictive model, having parameters that are determined using methods derived from waveform coding. For this reason, this category is often referred to as hybrid coding. For example, CELP (code excited linear prediction) coding belongs to this second category. In CELP coding, the input signal is coded by means of a "source-filter" model inspired by the speech production process. The parameters transmitted represent separately the source (or "excitation") and the filter. The filter is generally an all-pole filter. The basic concepts of coding audio-frequency signals and more particularly of CELP coding and quantization are explained in the following works in particular: W. B. Kleijn and K. K. Paliwal, editors, Speech Coding and Synthesis, Elsevier, 1995, and Nicolas Moreau, Techniques de compression des signaux [Signal compression techniques], Collection Technique et Scientifique des Télécommunications, Masson, 1995.

The third category includes coding techniques such as MPEG 1 and 2 Layer III, better known as MP3, or MPEG 4 AAC.

The ITU-T G.729 system is one example of CELP coding designed for speech signals in the telephone band (300 hertz (Hz)-3400 Hz) sampled at 8 kilohertz (kHz). It operates at a fixed bitrate of 8 kilobits per second (kbps) with 10 milliseconds (ms) frames. Its operation is specified in detail in ITU-T Recommendation G.729, Coding of Speech at 8 kbps using Conjugate Structure Algebraic Code Excited Linear Prediction (CS-ACELP), March 1996.

FIGS. 1(*a*), 1(*b*) and 1(*c*) together constitute a simplified diagram of the associated coder and decoder. FIG. 1(*c*) shows how the G.729 decoder reconstructs the speech signal from data supplied by the demultiplexer (112). The excitation is reconstituted into 5 ms sub-frames by adding two contributions:

- an innovator code (113), 5 ms long, consisting of 4 pulses ±1 scaled by a gain $g_c$, (114 and 118) and zeros;
- a 5 ms block taken in the past of the excitation and shifted by a fractional delay (specified by the pitch parameters T0, T0_frac) (115 and 116), scaled by a gain $g_p$ (117 and 118).

The excitation decoded in this way is shaped by a $10^{th}$ order LPC (linear predictive coding) synthesis filter 1/A(z) (120), having coefficients that are decoded (119) in the LSF (line spectrum frequency) domain from pairs of spectrum lines and interpolated at 5 ms sub-frame level. To improve quality and to mask certain coding artefacts, the reconstructed signal is then processed by an adaptive post-filter (121) and a post-processing high-pass filter (122). The FIG. 1(*c*) decoder therefore relies on the "source-filter" model to synthesize the signal. The parameters associated with this model are listed in the FIG. 2 table, with those describing the excitation distinguished from those describing the filter.

FIG. 1(*a*) represents a very high level diagram of the G.729 coder. It therefore shows the pre-processing high-pass filtering (101), the LPC analysis and quantization (102), the coding of the excitation (103) and the multiplexing of the coding parameters (104). The pre-processing and LPC analysis and quantizing blocks of the G.729 coder are not discussed here; for more details see the ITU-T recommendation referred above. FIG. 1(*b*) is a diagram of the excitation coding. It shows how the excitation parameters listed in FIG. 2 are determined and quantized. The excitation is coded in three steps:

- determination of the pitch delay (106) and estimation of the pitch gain (107);
- determination of the parameters of the innovator code in the ACELP dictionary (positions and signs of the 4 pulses (108)) and estimation of the gain (109);
- conjoint coding of the pitch and code gains.

The excitation parameters are determined by minimizing the quadratic error (111) between the CELP target (105) and the excitation filtered by W(z)/Â(z) (110). This process of analysis by synthesis is described in detail in the ITU-T recommendation referred to above.

In practice, the complexity of the G.729 coder/decoder (codec) is relatively high (around 18 WMOPS (weighted million operations per second)). To meet the requirements of applications such as simultaneous transmission of voice and data via DSVD (digital simultaneous voice and data) modems, an interworking system of lesser complexity (around 9 WMOPS) is also recommended by the ITU-T: the G.729A codec. This is described and compared to the G.729 codec in R. Salami et al., Description of ITU-T Recommendation G.729 Annex A: Reduced complexity 8 kbps CS-ACELP codec, ICASSP 1997.

Of the significant differences between G.729 and G.729A, that which reduces the G.729 complexity the most relates to searching in the ACELP dictionary: in the G.729A coder an in-depth search firstly of the four signed pulses replaces the interleaved loop search used in the G.729 coder. By virtue of its low complexity, the G.729A codec is now very widely used in voice over IP or ATM applications in the telephone band (300-3400 Hz).

With the growth of optical fiber and broadband networks such as ADSL, deploying new services can now be envisaged, such as bidirectional communication of much higher quality than standard systems using the telephone band. One step in this direction is to provide "wideband" quality, i.e. to use audio-frequency signals sampled at 16 kHz and limited to a usable band of 50 Hz-7000 Hz. The quality obtained is then similar to that of AM radio.

The choice of a codec for deploying "wideband" quality instead of "narrowband" quality must take a number of important factors into account.

- The infrastructure of existing IP networks and connection points (telephone modems, ADSL, LAN, WiFi, etc.) is extremely heterogeneous in terms of bitrate, quality of service as characterized by jitter, bitrate of loss of packets, etc.
- The terminals reproducing the sounds (telephone, PC or other) sometimes differ in terms of sampling frequency and the number of audio channels. It is sometimes difficult to tell in advance in the coder the real capacity of the terminals.
- Numerous standards for coding audio-frequency signals (including the G.729 and G.729A codecs) are already deployed in networks. Transcoding between the various associated formats is often necessary (for example in gateways or routers), although this generally implies a loss of quality and non-negligible complexity.

The approach known as "hierarchical" coding is the technical solution best suited to taking account of all these constraints.

Unlike conventional coding, such as G.729 or G.729A coding, generating a bit stream at fixed bitrate, hierarchical coding generates a bit stream that can be decoded in whole or in part. As a general rule, hierarchical coding comprises a core layer and one or more enhancement layers. The core layer is generated by a low fixed bitrate core codec, guaranteeing the minimum coding quality. This layer must be received by the decoder to maintain an acceptable quality level. The enhancement layers serve to improve quality. However, it can happen that they are not all received by the decoder, because of transmission errors, for example in the event of congestion of an IP network.

This technique therefore offers great flexibility in terms of the choice of the bitrate and the quality of reconstruction. The coder always assumes that the bitrate is the maximum bitrate. However, anywhere in the communication chain the bitrate can be adapted simply by truncating the bit stream. Hierarchical coding can moreover progressively deploy wideband quality, relying on a standard of the CELP coding in the telephone band type (such as the ITU-T G.729 and G.729A standards).

Of the various approaches to hierarchical coding based on a CELP core coder, the following four techniques may be mentioned:

- hierarchical CELP coding with excitation enrichment as described in the paper by R. D. De lacovo, D. Sereno, Embedded CELP coding for variable-rate between 6.4 and 9.6 kbps, ICASSP 1991;
- band extension with transmission of auxiliary information as described in the paper by J.-M. Valin et al., Bandwidth Extension of Narrowband Speech for Low Bit-Rate Wideband Coding, Proc. IEEE Speech Coding Workshop (SCW), 2000, pp. 130-132.
- in the paper by S. K. Jung, K-T. Kim, H-G. Kang, A bit/rate band scalable speech coder based on ITU-T G.723.1 standard, ICASSP 2004, a hierarchical coder is constructed from a G.723.1 coder with two enhancement layers, the first being of the telephone band cascade CELP type and the second being high-band transform coding attained by QMF (quadrature mirror filter) filtering;
- in the paper by H. Taddéi et al., A scalable Three Bit rate (8, 14.2 and 24 kbps) Audio Coder, 107$^{th}$ Convention AES 1999, the coding uses a G.729 8 kbps core coder, an intermediate telephone band enhancement layer to increase the bitrate to 14.2 kbps, followed by a wideband enhancement layer using transform coding to reach 24 kbps.

The difference between the concept of hierarchical CELP coding by excitation enrichment and the coding shown in FIG. 1(*b*) lies in the addition of an innovator dictionary to represent the CELP target better. This coding approach is in fact similar to multistage quantizing effected in the domain of the CELP target (or "perceptually" weighted domain). This additional dictionary enriches, or enhances, the decoded excitation because it is in fact added at the decoder level to the cumulative contribution of the two adaptive and fixed dictionaries of standard CELP decoding as shown in FIG. 1(*c*). This. CELP excitation enrichment principle can also be varied to include an additional adapted dictionary or a plurality of innovator dictionaries.

The band extension system proposed in the above paper by J.-M. Valin is shown in the FIG. 3 diagram. A signal in the telephone band (300 Hz-3400 Hz) is widened to the 0-8000 Hz wideband by adding (31) three contributions:

- a baseband regenerated by the block (32);
- the telephone band signal, for example coded by the G.729 system (40) and resampled by the block (33) at 16 kHz;
- a high band constructed with aid of the blocks (34) to (39).

Note more particularly in this diagram the extension of the highband, which is founded on the "source-filter" model. This begins with a narrowband LPC analysis (34) that determines the coefficients of the prediction filter $A_{NB}(z)$ (36). The result of this LPC analysis is also used by the LPC envelope extension unit (35) to determine the coefficients of a full-band LPC synthesis filter $1/B_{WB}(z)$ (38). Envelope extension can be effected using codebook mapping techniques, for example, with no transmission of auxiliary information, or with explicit information requiring transmission by quantization at a low additional bitrate. In parallel, the narrowband LPC residual (or excitation) signal is calculated by the unit (36). The resulting excitation sampled at 8 kHz is extended to the sampling frequency of 16 kHz by the unit (37). This operation can be carried out in the excitation domain by employing non-linearity, oversampling and filtering, in order to extend the harmonic structure and to whiten the full-band excitation. The extended excitation is then shaped by the full-band synthesis filter $1/B_{WB}$ (38) and the result is limited by the high-pass filter (39) to the 3400 Hz-8000 Hz band.

All known techniques of the prior art give rise to the following problems, however:

- wideband speech degraded by certain artefacts, such as aliasing caused by the use of a bank of QMF filters;
- music badly coded by the models linked to the speech production process;
- high bitrate granularity;
- quality degraded by the presence of pre-echo in the enhancement layer using transform coding;
- delay and complexity.

Moreover, certain fundamental problems are rarely touched on in the prior art: the phase non-linearity of pre-processing and post-processing is only rarely taken into account. The enhancement layers rely on coding a difference signal between original (pre-processed or not) and synthesis of the lower layer have badly degraded performance if the phase non-linearity (or group delay) of the pre-processing and post-processing filters is not compensated or eliminated.

SUMMARY OF THE INVENTION

One aspect of the invention is directed to a system for coding a hierarchical audio signal, comprising, at least, a core layer using parametric coding by analysis by synthesis in a first frequency band, a band extension layer for widening said first frequency band into a second frequency band, or wideband, noteworthy in that said system also comprises a wideband audio coding quality enhancement layer based on transform coding using a spectral parameter obtained from said band extension layer.

It should be emphasized here that the term "wideband" used in this description corresponds to a particular instance of the general concept of "extended band". Here "wideband" means a frequency band resulting from the extension of a first band, the telephone band of 300 Hz to 3400 Hz, to a second band, the wideband, of 50 Hz to 7000 Hz.

An advantageous embodiment of said system also comprises a first frequency band audio coding quality enhancement layer.

In a first embodiment of the coding system of the invention, said spectral parameter is a spectral envelope obtained from the band extension layer. Two embodiments can be envisaged: said spectral envelope is specified by a wideband linear prediction filter, or said spectral envelope is given by the energy per sub-band of the signal.

In a second embodiment of the coding system of the invention, said spectral parameter is at least a portion of the transform of the signal synthesized by the band extension layer. Said system then advantageously comprises a module for progressive adjustment of the energy in the sub-bands of the transform of the signal synthesized by the band extension layer.

An embodiment of the invention provides for said parametric coding by analysis by synthesis to be CELP coding. In particular, said CELP coding is G.729 coding or G.729A coding.

Accordingly, as seen in detail below, the coding system proposed by the invention constitutes a hierarchical coding system able to operate at bitrates of 8 kbps to 12 kbps, for example, and at all bitrates of 14 kbps to 32 kbps.

In response to the problems raised by the prior art, a coding/decoding system according to an embodiment of the invention is such that:

- wideband synthesized speech has no pre-echo, and no aliasing type artefacts are present;
- music is well coded at a sufficiently high bitrate (in the range 24 kbps to 32 kbps);
- the bitrate granularity is very fine (to the nearest bit) in the range 14 kbps to 32 kbps.

Another aspect of the invention is directed to a method of implementing the coding system according to the first embodiment, comprising the following steps:

- coding an original signal in said first frequency band;
- coding the original signal in an extension of the first frequency band, using a spectral envelope;
- calculating a residual signal from the original signal and the signals obtained from the preceding coding operations;

noteworthy in that said method also comprises a step of producing an audio coding quality enhancement layer using transform coding, said transform coding of said residual signal using said spectral envelope.

Another aspect of the invention is directed to a method of implementing the coding system according to the second embodiment, comprising the following steps:

- coding an original signal in said first frequency band;
- coding the original signal in an extension layer of the first frequency band;
- calculating a residual signal from the original signal and the signals obtained from the preceding coding operations;

noteworthy in that said method also comprises a step of producing an enhancement layer using transform coding of said residual signal, said transform coding using the transform of the signal synthesized by the band extension layer.

Said method advantageously comprises a step of progressively adjusting the energy in the sub-bands of the transform of the signal synthesized by the band extension layer.

Another aspect of the invention is directed to a computer program comprising program instructions for executing the steps of the method according to the invention when said program is executed by a computer.

Another aspect of the invention is directed to a first hierarchical audio coder comprising:

- a core coder using parametric coding by analysis by synthesis, adapted to code an original signal in a first frequency band;
- a coding stage in an extension of the first frequency band, comprising a spectral envelope;
- a stage for calculating a residual signal from the original signal and the signals obtained from the preceding coding stages;

noteworthy in that said coder also comprises a wideband audio coding quality enhancement stage using transform coding including an inverse transform using said spectral envelope.

Another aspect of the invention is directed to a second hierarchical audio coder comprising:

- a core coder using parametric coding by analysis by synthesis, adapted to code an original signal in a first frequency band;
- a coding stage in an extension of the first frequency band;
- a stage for calculating a residual signal from the original signal and the signals obtained from the preceding coding stages;

noteworthy in that said coder also comprises a wideband audio coding quality enhancement stage using transform coding using the transform of the signal synthesized by the band extension layer.

The invention further provides Another aspect of the invention is directed to a first hierarchical audio decoder comprising:

- a core decoder using parametric coding by analysis by synthesis, adapted to decode in a first frequency band a received signal coded by the first coder;
- a decoding stage in an extension of the first frequency band, comprising a spectral envelope;

noteworthy in that said decoder also comprises a wideband audio decoding quality enhancement stage using transform decoding including an inverse transform using said spectral envelope.

Another aspect of the invention is directed to a second hierarchical audio decoder comprising:

- a core decoder using parametric coding by analysis by synthesis, adapted to decode in a first frequency band a received signal coded by the second coder;
- a decoding stage in an extension of the first frequency band;

noteworthy in that said decoder also comprises a wideband audio decoding quality enhancement stage using transform decoding including an inverse transform using the transform of the signal synthesized by the band extension layer.

BRIEF DESCRIPTION OF THE DRAWINGS

FIG. 2 is a table of parameters associated with a "source-filter" model for synthesizing a signal.

FIG. 4(*b*) is a diagram of the fourth stage of the coder from FIG. 4(*a*), which is a coding stage.

FIG. 5 is a table of the coefficients of the low-pass filter used in the present invention.

FIG. 6 is a table of the coefficients of the high-pass filter used to generate a wideband enhancement signal in accordance with the invention.

FIG. 7 is a table specifying the division in sub-bands of the MDCT spectra in accordance with the invention.

FIG. 8 is a table giving the number of bits allocated for each frame to each of the parameters of a coder and a decoder according to the present invention.

FIG. 10(*b*) is a detailed diagram of the transform predictive decoding stage of the decoder from FIG. 10(*a*).

DETAILED DESCRIPTION OF THE DRAWINGS

Figure 1A:
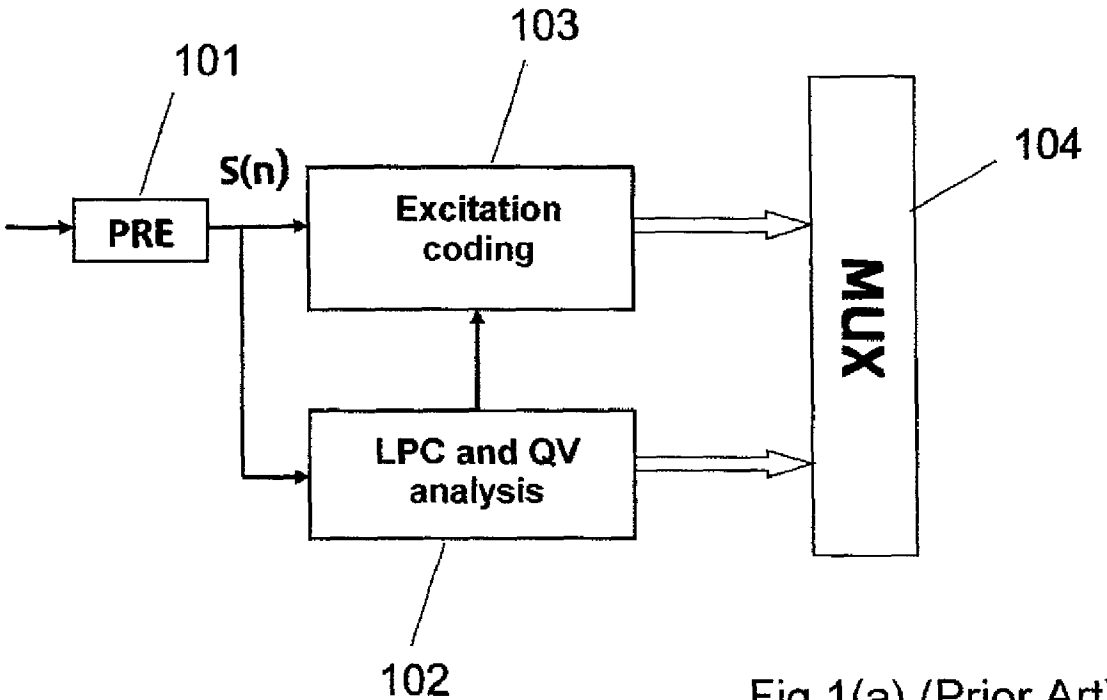
Fig.1(a) (Prior Art)
FIGS. 1(*a*), 1(*b*) and 1(*c*) depict a simplified diagram of a coder and decoder for code excited linear prediction speech signal coding.
Figure 1B:
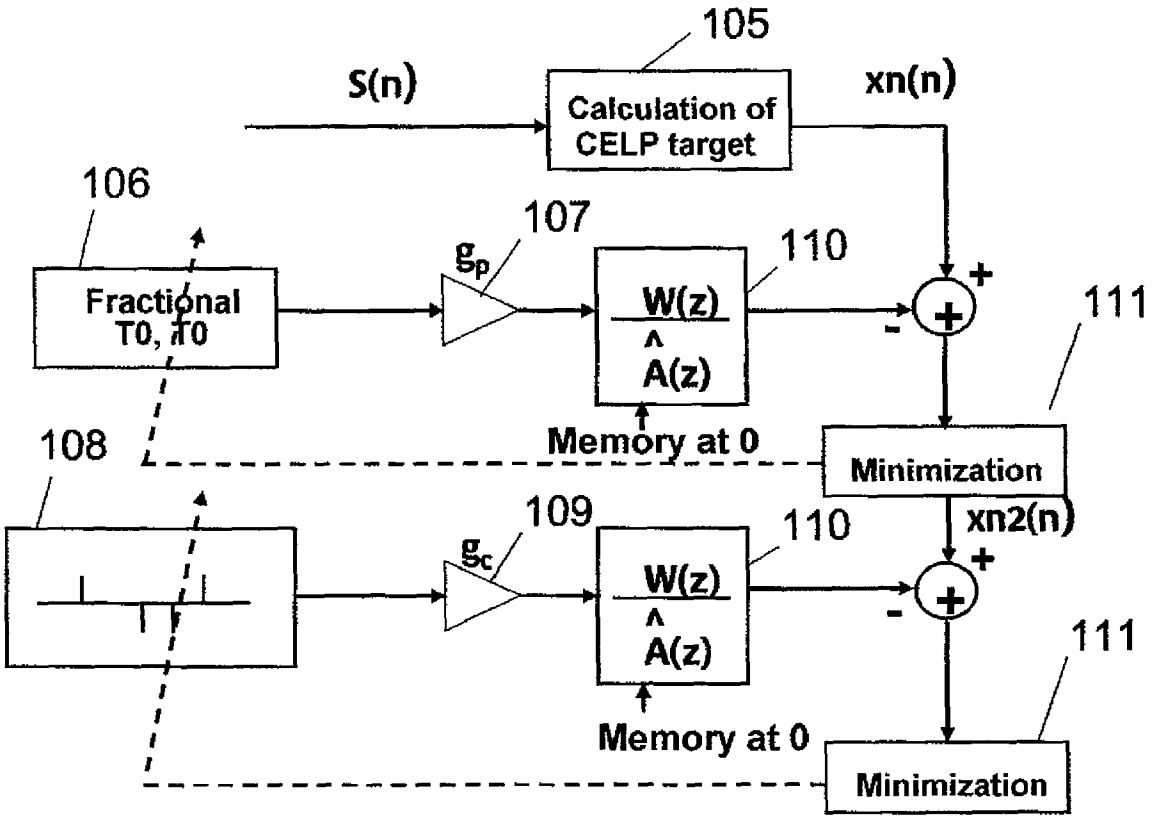
Fig.1(b) (Prior Art)
Figure 1C:
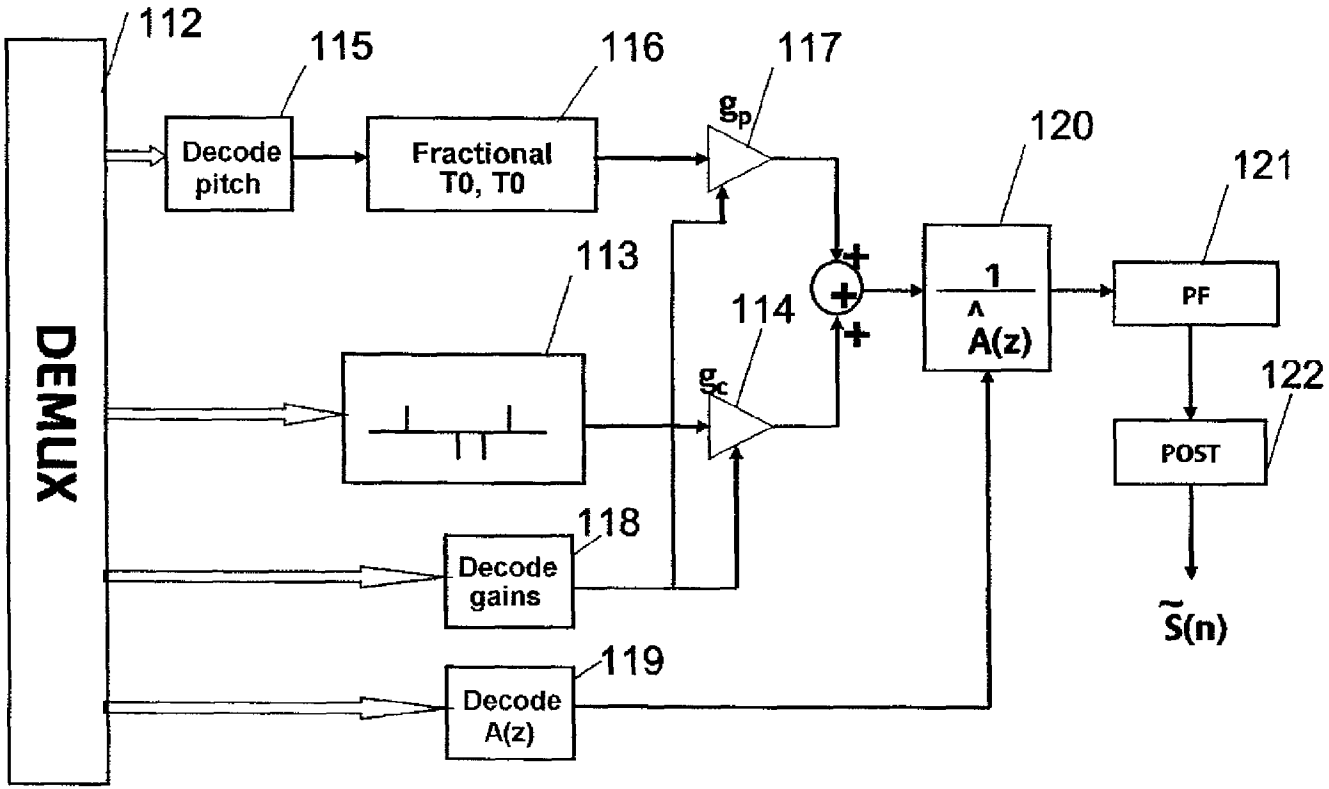
Fig.1(c) (Prior Art)
Figure 3:
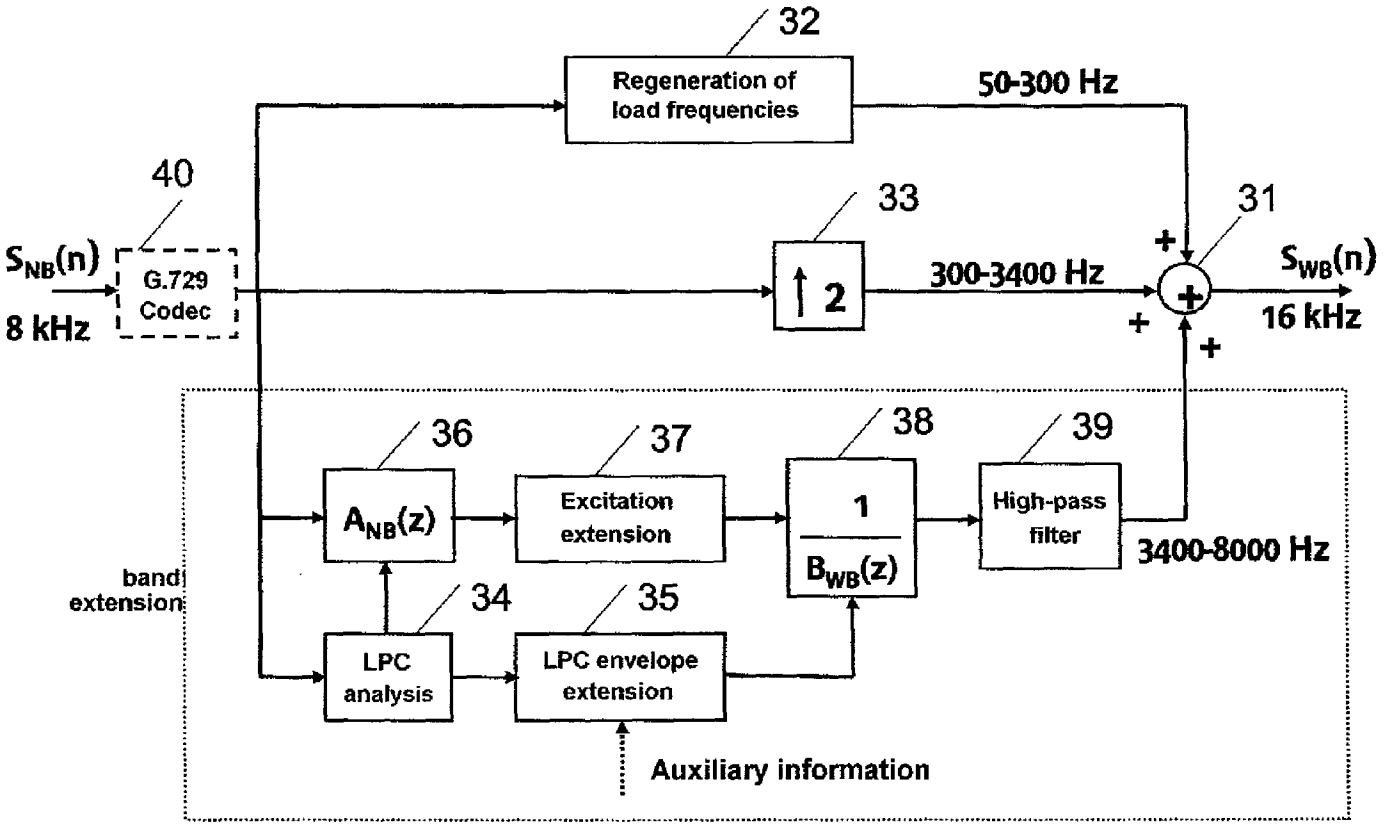
Fig.3 (Prior Art)
FIG. 3 depicts a proposed band extension system in which a signal in the telephone band (300 Hz-3400 Hz) is widened to the 0-8000 Hz wideband.
Figure 4A:
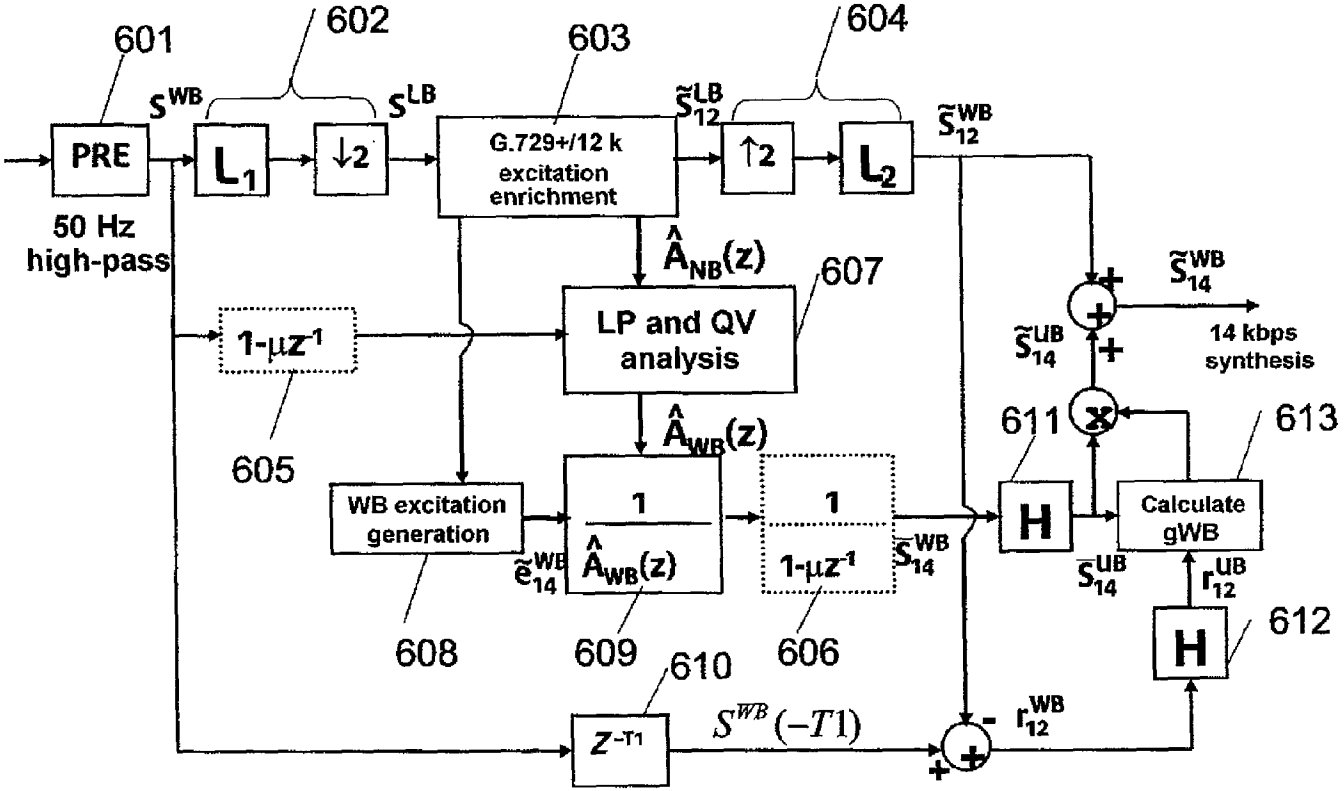
FIG. 4(*a*) is a diagram of the first three stages of a coder according to the present invention.
Figure 4B:
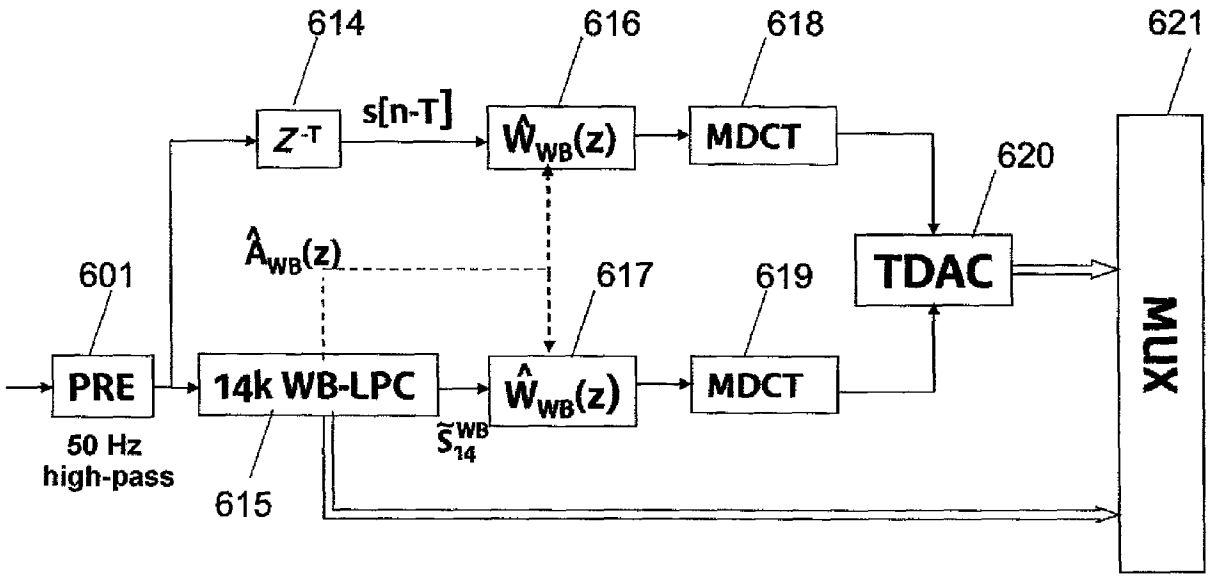

FIGS. 4(*a*) to 10(*b*) show a hierarchical coding/decoding system consisting of a coder and a decoder that are described in succession next.

In the remainder of this description it should be recalled that the term "wideband" refers to the particular circumstance of a telephone band 300 Hz-3400 Hz extended to 50 Hz-7000 Hz domain.

FIG. 4(*a*) is a block diagram of the coder. An original audio signal with a usable band between 50 and 7000 Hz and sampled at 16 kHz is divided into frames of 320 samples, or 20 ms. High-pass filtering 601 with a cut-off frequency of 50 Hz is applied to the input signal. The signal $S^{WB}$ obtained is used in multiple branches of the coder and corresponds to the signal really coded.

Firstly, in a first branch, low-pass filtering (having coefficients as set out in the FIG. 5 table) and undersampling 602 by a factor of two are applied to $S^{WB}$. This produces a telephone band signal $S^{LB}$ sampled at 8 kHz. That signal is processed by the core coder 603, for example by CELP G.729A+ type coding. Here the G.729A+ coder corresponds to the G.729 coder with no high-pass filtering pre-processing, for which the search in the ACELP dictionary has been replaced by that of G.729A as described above. Variants of this embodiment could use G.729A or G.729 coders or other CELP type coders without pre-processing. This coding gives the core of the bit stream with a bitrate of 8 kbps for the G.729A+ coder.

A first enhancement layer then introduces a second stage 603 of CELP coding. This second stage consists in an innovator code consisting of four additional ±1 pulses for a 5 ms subframes (dictionary equivalent to that of G.729A), these pulses are scaled by a gain $g_{enh}$. The principle of this enhancement stage has already been described above with reference to the paper by R. D. De lacovo. This dictionary enriches the CELP excitation and offers a quality improvement, particularly for non-voiced sounds. The bitrate of this second coding stage is 4 kbps and the associated parameters are the positions and the signs of the pulses and the associated gain for each sub-frame of 40 samples (5 ms at 8 kHz). In a variant of this embodiment, this coding stage uses other enhancement modes, for example those described in the De lacovo paper referred to above.

The core coder and the first enhancement layer are decoded to obtain the 12 kbps telephone band synthesis signal. It is important to note that the adaptive post-filtering and post-processing (high-pass filtering) of the core coder are deactivated in order to take account of the non-linear phase-shift of these operations; the difference between the original pre-process signal and the synthesis at 8 and 12 kbps is therefore minimized. Oversampling and low-pass filtering 604 produce the version sampled at 16 kHz of the first two stages of the coder.

The wideband signal is produced by the second enhancement layer, also called the band extension layer. The input signal $S^{WB}$ can be filtered by a pre-emphasis filter 605 with $\mu$=0.68. This filter provides a better representation of the higher frequencies from the wideband linear prediction filter. To compensate the effect of the pre-emphasis filter, a dual de-emphasis filter 606 is then used in the synthesis process. In a preferred embodiment, no pre-emphasis and de-emphasis filters are used in the coding and decoding structure. The next step calculates and quantizes the wideband linear prediction filter 607. The linear prediction filter is an $18^{th}$ order filter, but in a variant of this embodiment another prediction order is chosen, for example a lower order ($16^{th}$ order). The linear prediction filter can be calculated by the autocorrelation method using the Levinson-Durbin algorithm.

This wideband linear prediction filter $\hat{A}^{WB}(z)$ is quantized using a prediction of these coefficients, where applicable from the filter $\hat{A}^{NB}(z)$ from the telephone band core coder 603. The coefficients can then be quantized using multistage vector quantization, for example, and the dequantized LSF parameters of the telephone band core coder, as described in the paper by H. Ehara, T. Morii, M. Oshikiri and K. Yoshida, Predictive VQ for bandwidth scalable LSP quantization, ICASSP 2005.

The wideband excitation 608 is obtained from telephone band excitation parameters of the core coder: the pitch delay, the associated gain, and the algebraic excitations of the core coder and the first CELP excitation enrichment layer and the associated gains. This excitation is generated using an oversampled version of the parameters of the telephone band stage excitation. In a variant of this embodiment, the excitation is calculated from the pitch delay and the associated gain, these parameters being used to generate harmonic excitation from white noise. In this variant, the excitation from the algebraic dictionary is replaced by white noise.

This wideband excitation is then filtered by the synthesis filter 609 previously calculated. If pre-emphasis has been applied to the input signal, the de-emphasis filter 606 is applied to the output signal of the synthesis filter. The signal obtained is a wideband signal that has not had its energy adjusted. To calculate the gain for leveling the energy of the high band (3400-7000 Hz), high-pass filtering 611 (having coefficients as set out in the FIG. 6 table) is applied to the wideband synthesis signal. In parallel with this, the same high-pass filter 612 is applied to the error signal corresponding to the difference between the delayed original signal 610 and the synthesis signal of the preceding two stages. These two signals are then used to calculate the gain to be applied to the wideband synthesis signal. This gain is calculated by an energy ratio between the two signals. The gain $g_{WB}$ 611 is then applied to the signal $S^{14}_{UB}$ at the level of a sub-frame of 80 samples (5 ms at 16 kHz). The signal obtained in this way is added to the synthesis signal from the preceding stage to create the wideband signal corresponding to the bitrate of 14 kbps.

The remainder of coding is effected in the frequency domain using a transform predictive coding scheme using the linear prediction filter from the band extension layer.

This coding stage constitutes the wideband coding quality enhancement layer.

FIG. 4(*b*) shows this portion of the coder. The delayed input signal 614 and synthesis signal at 14 kbps 615 are filtered by respective perceptual weighting 616 and 617 of $A_{WB}(z/\gamma)*(1-\mu z)$, typically with $\gamma=0.92$ and $\mu=0.68$. These signals are then encoded by the transform coding scheme.

A modified discrete cosine transform (MDCT) is applied: both to blocks of 640 samples of the weighted input signal 618 with an overlap of 50% (refreshing of the MDCT analysis every 20 ms), and also to the weighted synthesis signal 619 from the preceding band extension stage at 14 kbps (same block length and same overlap). The MDCT spectrum 620 to be encoded corresponds to the difference between the weighted input signal and the synthesis signal at 14 kbps for the 0 to 3400 Hz band and to the weighted input signal from 3400 Hz to 7000 Hz. The spectrum is limited to 7000 Hz by setting to zero the last 40 coefficients (only the first 280 coefficients are coded). The spectrum is divided into 18 bands: one band of eight coefficients and 17 bands of 16 coefficients as set out in the FIG. 7 table. A variant of this embodiment uses 20 bands of equal width (14 coefficients). For each band of the spectrum, the energy of the MDCT coefficients is calculated (scale factors). The 18 scale factors constitute the spectral envelope of the weighted signal that is then quantized, coded, and transmitted in the frame.

Figure 9:
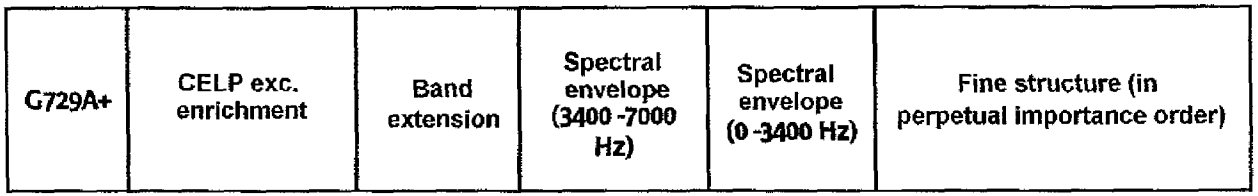
FIG. 9 represents the structure of the bit stream associated with the present invention.

The scale factors of the high band (3400 Hz-7000 Hz) are transmitted before those of the low band (0-3400 Hz), as the bit stream format shown in FIG. 9 indicates.

Dynamic bit allocation is based on the energy of the bands of the spectrum from the de-quantized version of the spectral envelope. This achieves compatibility between the binary allocation of the coder and the decoder. The allocation of bits in the TDAC (time domain aliasing cancellation) module 620 is effected in two phases. Firstly, a first calculation of the number of bits to allocate to each band is effected; each of the values obtained is rounded to the closest available dictionary bitrate. If the total bitrate allocated is not exactly equal to that available, a second phase is used to make the adjustment. This step is effected by an iterative procedure based on an energy criterion that adds bits to the bands or removes bits from the bands as described in the paper by Y. Mahieux and J. P. Petit, Transform coding of audio signals at 64 kbps, IEEE GLOBECOM 1990. Thus if the total number of bits distributed is less than that available, bits are added to the bands in which the perceptual enhancement is the greatest (greatest energy). In the contrary situation where the total number of bits distributed is greater than that available, the extraction of bits from the bands is effected in a dual manner.

The normalized (fine structure) MDCT coefficients in each band are then quantized by vectorial quantizers using dictionaries interleaved in size and in resolution, the dictionaries consisting of a union of permutation codes as described in international application WO/0400219. Finally, the information on the core coder, the telephone band CELP enrichment stage, the wideband CELP stage, and, finally, the spectral envelope and decoded normalized coefficients, is multiplexed and transmitted in frames.

The number of bits allocated to each of the parameters of the coder and decoder is set out in the FIG. 8 table.

The frame structure of the bit stream is shown in FIG. 9.

Figure 10A:
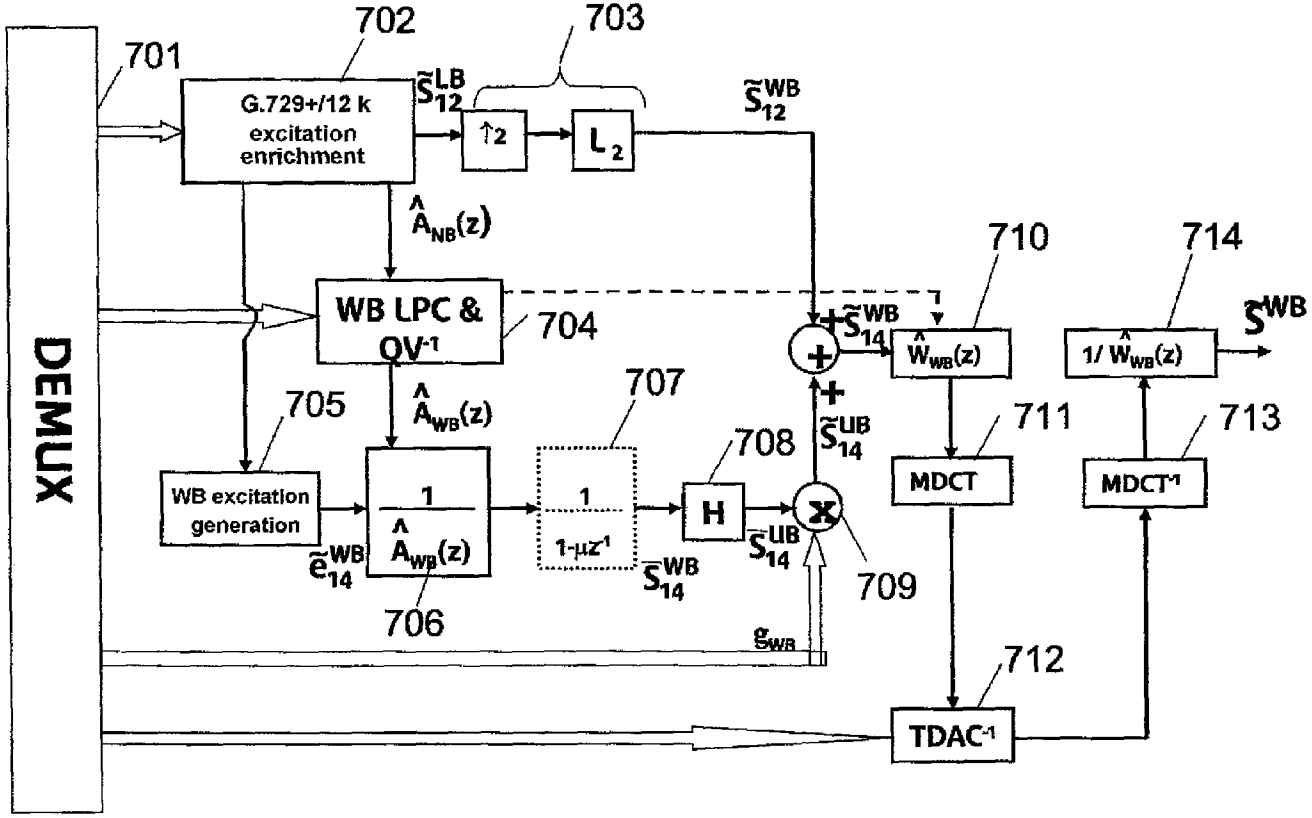
FIG. 10(*a*) is a general diagram of the four-layer decoder according to the present invention.
Figure 10B:
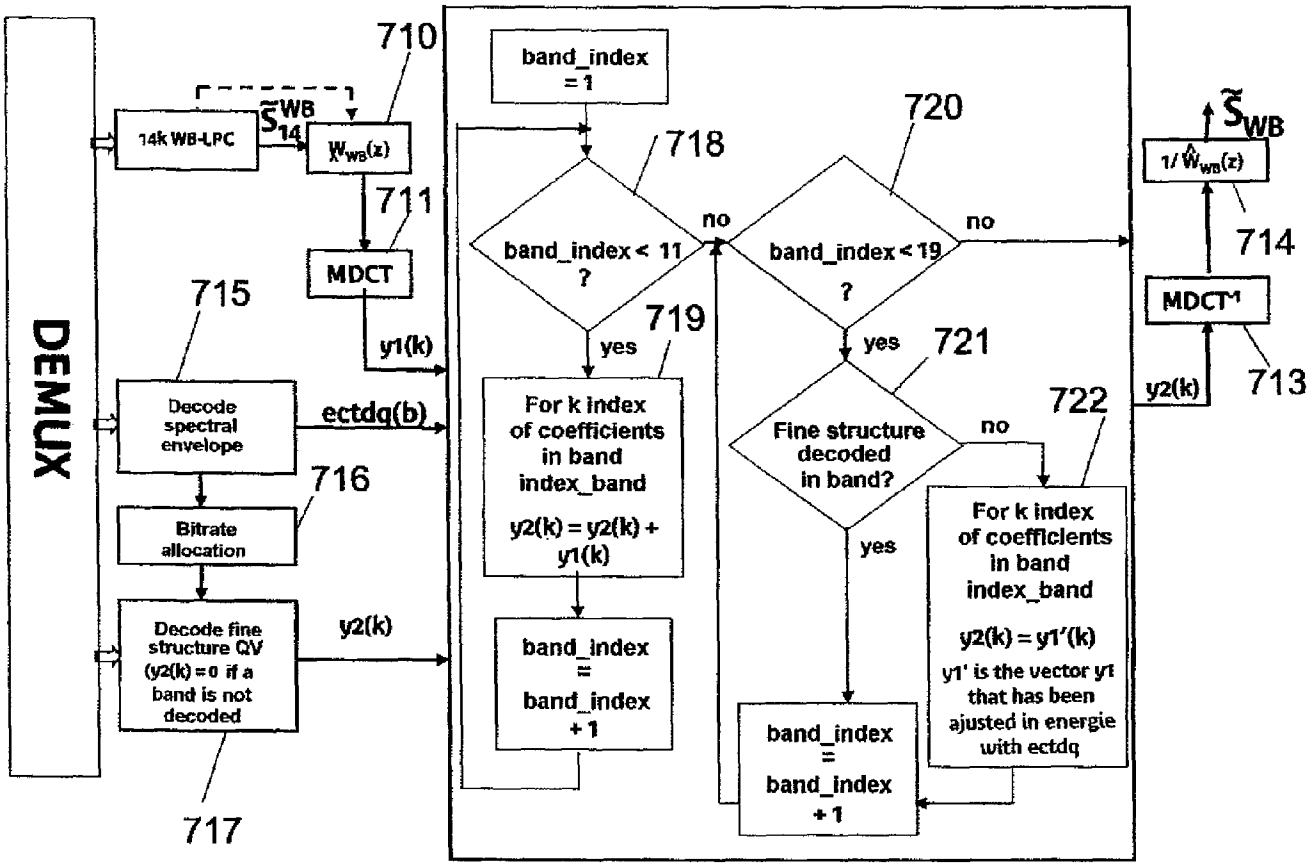

The structure of the decoder is described next with reference to FIGS. 10(*a*) and 10(*b*).

The module 701 demultiplexes the parameters contained in the bit stream. There are multiple decoding situations as a function of the number of bits received for a frame, of which the first three are described with reference to FIG. 10(*a*) and the last with reference to FIG. 10(*b*):

1. The first concerns the reception of the minimum number of bits by the decoder. In this situation, only the first stage is decoded. Thus only the bit stream relating to the CELP (G.729+) type core decoder 702 is received and decoded. This synthesis can be processed by the adaptive post-filter and the post-processing of the G.729 decoder. This signal is oversampled and filtered to produce a signal sampled at 16 kHz (703).

2. The second situation concerns the reception of the number of bits relating to the first and second decoding stages. In this situation, the core decoder and the first CELP excitation enrichment stage are decoded. This synthesis can be processed by the adaptive post-filter and the post-processing of the G.729 decoder. This signal is oversampled and filtered to produce a signal sampled at 16 kHz (703).

3. The third situation corresponds to the reception of the number of bits relating to the first three decoding stages. In this situation, the first two decoding stages are first effected as in situation 2, after which the band extension module generates a signal sampled at 16 kHz after decoding the parameters of the wideband pairs of spectral lines (WB-LSF) (704) and the gains associated with the excitation. The wideband excitation is generated from the parameters of the core coder and the first CELP enrichment stage 705. This excitation is then filtered by the synthesis filter 706 and where appropriate by the de-emphasis filter 707 if a pre-emphasis filter was used in the coder. A high-pass filter 708 is applied to the signal obtained and the energy of the band extension signal is adapted by means of the associated gains (709) every 5 ms. This signal is then added to the telephone band signal sampled at 16 kHz obtained from the first two decoder stages. With the aim of obtaining a signal limited to 7000 Hz, this signal is filtered in the transform domain by setting to 0 the last 40 MDCT coefficients before passing through the inverse MDCT transform 713 and the weighted synthesis filter 714.

4. This last situation corresponds to the decoding of the last stage of the decoder (FIG. 10(*b*)). This stage corresponds to the wideband decoding quality enhancement layer. This stage consists of a predictive transform decoder using the linear prediction filter from the band extension layer. The step 3 described above is carried out first and the decoding scheme is then adapted as a function of the number of additional bits received:

If the number of bits corresponds to only a portion of the spectral envelope 715, or to the whole of it but without the fine structure being received (721), the partial or complete spectral envelope is used to adjust the energy of the bands of MDCT coefficients (722) between 3400 Hz and 7000 Hz (720) corresponding to a portion of the transform of the signal generated by the band extension stage 711. This system achieves progressive enhancement of audio quality as a function of the number of bits received.

If the number of bits corresponds to the whole of the spectral envelope and to a portion or the whole of the fine structure, bit allocation is effected in the same way as in the encoder 716. In the bands in which the fine structure is received, the decoded MDCT coefficients are calculated from the spectral envelope 715 and the dequantized fine structure 717. In the spectral bands between 3400 Hz and 7000 Hz when the fine structure has not been received, the procedure from the preceding paragraph is used, i.e. the MDCT coefficients calculated from the signal obtained by extension of the band—which constitutes a spectral parameter derived from the band extension layer—are adjusted in energy on the basis of the received spectral envelope (722). The MDCT spectrum used for the synthesis is therefore constituted: firstly, of the synthesis signal in the first two decoding stages added to the decoded error signal in the bands in the range 0 to 3400 Hz (718 and 719); and secondly, for the bands in the range 3400 Hz to 7000 Hz the MDCT coefficients decoded in the bands in which the fine structure has been received and the MDCT coefficients of the band extension stage adjusted in energy for the other spectral bands (721 and 722).

An inverse MDCT transform is then applied to the decoded MDCT coefficients (713) and filtering by the weighted synthesis filter (714) produces the output signal.

In a variant of the embodiment described above, the predictive transform coding/decoding stage operates entirely on the difference signal between the original signal and the synthesis signal of the band extension stage in the range 0 to 7000 Hz.

In another variant of this embodiment, band extension is effected on coding and on decoding in the transform domain from a spectral envelope given by the energy of each sub-band of the signal and coding of the fine structure. This spectral envelope can be quantized by factor quantization. In this variant, the wideband enhancement stage uses TDAC type transform coding as described above (with no weighting filtering). Thus the spectral envelope that is given by the energy in each sub-band of the signal and that constitutes a spectral parameter is transmitted in band extension stage and re-used by the wideband enhancement layer.

Moreover, in an alternative embodiment, the first coded frequency band could correspond to the 50 Hz-7000 Hz wideband and the second coded frequency band could be an FM band (50 Hz-15000 Hz) or a HiFi band (20 Hz-2400 Hz).

The invention claimed is:

1. A system for coding a hierarchical audio signal, comprising, at least, a core coding module using parametric coding by analysis by synthesis in a first frequency band, a band extension coding module for widening said first frequency band into a second frequency band, or wideband, wherein said system also comprises a wideband audio coding quality enhancement module based on transform coding using a spectral parameter obtained from said band extension coding module.

2. A coding system according to claim 1, wherein said system also comprises a first frequency band audio coding quality enhancement module.

3. The coding system according to claim 1, wherein said spectral parameter is a spectral envelope obtained from the band extension coding module.

4. The coding system according to claim 3, wherein said spectral envelope is specified by a wideband linear prediction filter.

5. The coding system according to claim 3, wherein said spectral envelope is given by the energy per sub-band of the signal.

6. The coding system according to claim 1, wherein said spectral parameter is at least a portion of a transform signal obtained from the signal synthesized by the band extension coding module.

7. The coding system according to claim 6, wherein said system comprises a module for progressive adjustment of the energy in sub-bands of the transform signal obtained from the signal synthesized by the band extension coding module.

8. A method for coding an audio signal, comprising the steps of:

coding an original signal in a first frequency band;

coding the original signal in an extension of the first frequency band;

calculating a residual signal from the original signal and the signals obtained from the preceding coding operations; and producing an audio coding quality enhancement layer using transform coding, said transform coding of said residual signal using a spectral parameter obtained from the said extension of the first frequency band.

9. The method according to claim 8, wherein said spectral parameter is a spectral envelope obtained from the said extension of the first frequency band.

10. The method according to claim 8, wherein said spectral parameter is at least a portion of a transform signal obtained from the signal synthesized by the said extension of the first frequency band.

11. The method according to claim 8, wherein said method comprises a step of progressively adjusting the energy in sub-bands of the transform signal obtained from the signal synthesized by the said extension of the first frequency band.

12. A computer program stored on a non-transitory computer-readable medium and comprising program instructions for implementing the steps of the method according to claim 8, when said program is executed by a computer.

13. A hierarchical audio decoder, comprising:

a core decoder using parametric coding by analysis by synthesis, adapted to decode in a first frequency band a received signal coded by a coder comprising a core coding module using parametric coding by analysis by synthesis in the first frequency band, and a band extension coding module for widening said first frequency band into an extended frequency band;

a decoding module for decoding the extended frequency band of the first frequency band; and a wideband audio decoding quality enhancement stage using transform decoding including an inverse transform using a spectral parameter obtained from the decoding of the extended frequency band of the first frequency band.

14. The decoder according to claim 13, wherein said spectral parameter is a spectral envelope obtained from the decoding of the extended frequency band of the first frequency band.

15. The decoder according to claim 13, wherein said spectral parameter is at least a portion of a transform signal obtained from the signal synthesized by the decoding of the extended frequency band of the first frequency band.

16. The decoder according to claim 13, wherein said decoder comprises a module for progressive adaptation of the energy in sub-bands of the spectrum generated by transform coding.

17. The decoder according to claim 13, wherein said core decoder includes a first frequency band audio decoding quality enhancement module.

* * * * *